US008875552B2

(12) United States Patent
Fan

(10) Patent No.: US 8,875,552 B2
(45) Date of Patent: Nov. 4, 2014

(54) LOCK CYLINDER

(75) Inventor: Wai Kuen Fan, Tseung Kwan O (HK)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 277 days.

(21) Appl. No.: 12/250,751

(22) Filed: Oct. 14, 2008

(65) Prior Publication Data

US 2010/0050716 A1 Mar. 4, 2010

(30) Foreign Application Priority Data

Sep. 4, 2008 (DE) ..... 10 2008 045 739

(51) Int. Cl.

| | |
|---|---|
| ***E05B 63/00*** | (2006.01) |
| ***E05B 35/00*** | (2006.01) |
| ***E05B 27/00*** | (2006.01) |
| ***E05B 19/00*** | (2006.01) |
| ***E05B 35/10*** | (2006.01) |
| *E05B 65/52* | (2006.01) |
| *E05B 67/36* | (2006.01) |
| *E05B 37/00* | (2006.01) |

(52) U.S. Cl.

CPC ..... *E05B 27/00* (2013.01); *E05B 19/0017* (2013.01); *E05B 35/105* (2013.01); *E05B 27/0057* (2013.01); *E05B 65/52* (2013.01); *E05B 67/36* (2013.01); *E05B 37/0034* (2013.01); *E05B 19/0058* (2013.01)

USPC ..... 70/421; 70/285; 70/419; 70/493

(58) Field of Classification Search

USPC ..... 70/284, 285, 358, 417, 419, 493, 494, 70/495, 356, 373, 375, 420, 421, 492

See application file for complete search history.

(56) References Cited

U.S. PATENT DOCUMENTS 3,395,558 A * 8/1968 Russell et al. ..... 70/493
3,412,588 A * 11/1968 Schwegler ..... 70/358

(Continued)

FOREIGN PATENT DOCUMENTS

AT 258756 12/1967
DE 30 48 222 A1 9/1981

(Continued)

OTHER PUBLICATIONS

German Search Report dated Jun. 3, 2009. DE 10 2008 045 739.6.

(Continued)

*Primary Examiner* — Christopher Boswell

(74) *Attorney, Agent, or Firm* — Gifford, Krass, Sprinkle, Anderson & Citkowski, P.C.

(57) ABSTRACT

The invention relates to a lock cylinder for a baggage lock having a cylinder housing, furthermore having a cylinder core which is rotatable in the cylinder housing and which has a keyway with a key introduction opening and having a plurality of tumblers which are arranged in two rows which are oppositely disposed along the key channel, with the lock cylinder being able to be actuated by means of an associated dimpled key which comprises, on two mutually oppositely disposed flat sides, a respective coding section provided with dimples and a respective end section adjoining said coding section and extending up to the tip of the key, with the associated key in particular being of the type TSA006 and with the tumbler of at least one of the rows furthest from the key introduction opening being arranged in a section of the key channel which receives the dimple-free end section of the associated key.

8 Claims, 2 Drawing Sheets

(56) References Cited

U.S. PATENT DOCUMENTS

| | | | | | |
|---|---|---|---|---|---|
| 3,824,818 | A | * | 7/1974 | Neale | 70/358 |
| 4,098,104 | A | * | 7/1978 | Wolter | 70/406 |
| 4,403,486 | A | * | 9/1983 | Miyake | 70/383 |
| 4,433,487 | A | * | 2/1984 | Roland | 70/358 |
| 5,485,735 | A | * | 1/1996 | Laabs et al. | 70/358 |
| 5,531,084 | A | * | 7/1996 | Laabs et al. | 70/358 |
| 5,553,473 | A | * | 9/1996 | Keller | 70/358 |
| 5,685,184 | A | * | 11/1997 | Gallagher | 70/493 |
| 5,839,308 | A | * | 11/1998 | Eizen et al. | 70/358 |
| 6,513,356 | B1 | | 2/2003 | Yang et al. | |
| 6,598,434 | B2 | | 7/2003 | Yang et al. | |
| 6,910,356 | B2 | * | 6/2005 | Price | 70/358 |
| 6,912,880 | B2 | * | 7/2005 | Ling et al. | 70/284 |
| 7,021,537 | B2 | | 4/2006 | Tropp | |
| 7,036,728 | B2 | | 5/2006 | Tropp | |
| 7,181,937 | B2 | * | 2/2007 | Keller | 70/493 |
| 7,421,869 | B2 | * | 9/2008 | Osada | 70/358 |

FOREIGN PATENT DOCUMENTS

| | | | |
|---|---|---|---|
| DE | 30 48 222 | C2 | 9/1981 |
| DE | 10 2004 011 879 | A1 | 9/2005 |
| DE | 10 2004 0011879 | A1 | 9/2005 |
| DE | 20 2007 009 090 | U1 | 8/2007 |
| JP | 2002357031 | A | 12/2002 |
| JP | 2007135763 | A | 6/2007 |
| JP | 2009068166 | A | 4/2009 |

OTHER PUBLICATIONS

Japanese Office Action dated Mar. 5, 2013 relating to patent application No. 2009-203190.

Translation of European Search Report dated Aug. 22, 2013 relating to EP Patent Application No. 09 011 229.3.

* cited by examiner

LOCK CYLINDER

CROSS-REFERENCE TO RELATED APPLICATIONS

This application claims priority of German Patent Application DE 10 2008 045 739.6 filed Sep. 4, 2008.

FIELD OF THE INVENTION

The present invention relates to a lock cylinder for a baggage lock, in particular a TSA baggage lock, wherein the lock cylinder can be actuated by means of an associated dimpled key.

BACKGROUND OF THE INVENTION

Following the terrorist attacks of Sep. 11, 2001, security measures at airports in the USA were tightened. For the security of air passengers, all checked pieces of baggage are now screened by the responsible US security authority, the Transportation Security Administration (TSA). In some cases, the baggage is also opened and inspected by hand. If the piece of baggage affected by this is secured by a lock, the lock has to be opened by force.

To avoid the breaking open and thus the destruction of the respective lock, TSA locks have been developed which can be actuated using an associated special key. A TSA lock can hereby be opened by the TSA without destruction, with only the TSA having the respective special key and with a plurality of different coding types of such special keys being defined. The purchaser of a TSA lock or of a suitcase having a TSA lock, in contrast, does not have a special key, i.e. a TSA lock is only supplied without the special key. This mode of operation of a TSA lock is also explained on the internet website of the Transportation Security Administration (www.tsa.gov/travelers/airtravel/assistant/locks.shtm).

In the meantime, a number of manufacturers have introduced baggage locks with mechanical combination locks which can no longer only be opened via a combination mechanism, but can also be opened via a lock cylinder which can be actuated by means of such a TSA special key. These lock cylinders can, for example, be configured for a dimpled key having a standardized coding of the type TSA006. Such manufacturers of baggage locks are, for example, Travel Sentry, Inc., USA (www.travelsentry.org) or Safe Skies LC., New York, USA (www.safeskieslocks.com).

It has been found that TSA locks can be opened without authorization by the introduction of very simple manipulation tools or even everyday articles of use into the keyway of the lock cylinder.

SUMMARY OF THE INVENTION

It is the underlying object of the invention to provide a lock cylinder of the initially named kind which has increased security against being broken open.

This object is satisfied by a lock cylinder for a baggage lock having the features of claim 1 and in particular by a lock cylinder for a baggage lock having a cylinder housing, furthermore having a cylinder core which is rotatably in the cylinder housing and which has a keyway with a key introduction opening and having a plurality of tumblers which are arranged in two rows which are oppositely disposed along the keyway, with the lock cylinder being able to be actuated by means of an associated dimpled key which comprises, on two mutually oppositely disposed flat sides, a respective coding section provided with dimples and a respective end section adjoining said coding section and extending up to the tip of the key, with the associated key in particular being of the type TSA006 and with the tumbler of at least one of the rows furthest from the key introduction opening being arranged in a section of the keyway which receives the dimple-free end section of the associated key.

The lock cylinder in accordance with the invention is therefore matched to an associated dimpled key, in particular to the TSA006 key with a predetermined coding. The dimpled key has two flat sides. A first coding section with dimples which are arranged along a first row is provided on the first flat side. A first end section free of dimples adjoins the first coding section in the direction of the key tip. A second coding section with dimples which are arranged along a second row is provided on the second flat side. A second end section free of dimples adjoins the second coding section in the direction of the key tip.

The dimpled key is typically made as a reversible key. A further row of dimples corresponding to the second row of dimples of the second flat side is then provided on the first flat side, horizontally next to the first row of dimples, and a further row of dimples corresponding to the first row of dimples of the first flat side is provided on the second flat side, horizontally next to the second row of dimples.

The lock cylinder includes a cylinder housing, a cylinder core which is rotatable in the cylinder housing and which has a key introduction opening and a plurality of tumblers. The tumblers are arranged in two rows which are diametrically opposed along the keyway, with the first row of tumblers cooperating with the first row of dimples of the first flat side, or also of the second flat side, of the dimpled key and the second row of tumblers cooperating with the second row of dimples of the second flat side, or also of the first flat side, of the dimpled key when the dimpled key has been introduced into the keyway.

The tumbler of the first row of tumblers, or of the second row of tumblers, furthest from the key introduction opening is disposed in a section of the keyway which receives the first or second end section free of dimples of the dimpled key, i.e. this tumbler is provided remote from the respective coding section of the inserted key. The wording "the tumbler of at least one of the rows furthest from the key introduction opening" in this connection means that it does not have to be a question of the absolutely furthest tumbler (that is relative to all rows of tumblers). It is rather a question of the tumbler of the respective row of tumblers furthest from the key introduction opening.

The named furthest tumbler, optionally of each of the rows of tumblers, is therefore arranged deeper in the keyway, i.e. further remote from the key introduction opening of the keyway, than is provided in accordance with the predetermined coding of the associated key. The named tumbler is thus further remote from the key introduction opening than is the case with known lock cylinders, whereby lock picking is made considerably more difficult. The named furthest tumbler, optionally of each of the rows of tumblers, therefore does not cooperate with the respective coding section or one of the respective dimples of the associated dimpled key.

The lock cylinder can be made only for one single key coding, as is, for example, usually the case for the aforesaid baggage locks having a mechanical combination lock and having an additional TSA function, i.e. the lock cylinder is in this case only actuable with the associated special key. It is, however, generally also possible that the lock cylinder is part of a master key system which includes a plurality of lock cylinders, with the individual lock cylinder being able to be actuated both by an individual key by the user and by a master key—the associated special key—by the TSA.

In accordance with an embodiment, the cylinder core has a plurality of webs in a region which receives the key tip, with the webs extending in the key introduction direction and projecting into the keyway to engage in complementary formed grooves of the associated key when the associated key has been introduced into the keyway. The copying of the associated key is hereby made more difficult. In addition, keys which do not have the complementary grooves cannot be completely introduced into the keyway of the cylinder core.

The named furthest tumbler preferably include a core pin with a core pin axis which extends through a groove of the cylinder core formed between the webs of the cylinder core so that the core pin cooperates with a web of the associated key when the associated key has been introduced into the keyway. The security against lock picking can hereby be further increased since it is not possible easily to gain access to the groove of the cylinder core formed between the webs of the cylinder core using the initially named manipulation tools or everyday articles of use in order to urge the named furthest tumbler back out of the keyway.

In this respect, the core pin can cooperate with a chamfered part of the web of the associated key when the associated key has been introduced into the keyway.

The tumblers are preferably coded to different engagement depths at which the tumblers engage into the dimples of the associated key. The named furthest tumbler can then be coded to an engagement depth of zero, i.e. to the key blank from which the key was made, while the other tumblers are either coded to a first engagement depth which is larger than zero or to a second engagement depth which is larger than the first engagement depth. Alternatively to the aforesaid embodiment, the core pin then does not cooperate with a chamfered part of the web of the associated key, provided such a chamfered part is present, but with a part at which the web has its full height.

In accordance with another embodiment, with the exception of the named furthest tumbler, the tumblers arranged in a row have equidistant spacings from one another.

The keyway can furthermore be arranged off-center in the cylinder core. This is in particular of advantage when the dimpled key is made as a reversible key.

The invention furthermore relates to a baggage lock having a lock cylinder such as has been explained above, furthermore having a further locking device and having a latching mechanism for the latching of a zip or of a buckle of a piece of baggage, with the latching mechanism being able to be selectively secured or released by means of the locking device and with the latching mechanism being able to be released by means of the lock cylinder while bypassing the locking device. The further locking device can, for example, be the named mechanical combination mechanism. In addition to a conventional locking device, such a baggage lock consequently has a further mechanism, namely the lock cylinder explained above which allows the TSA to open the baggage lock with a special key.

Advantageous embodiments of the invention are also set forth in the dependent claims, in the description and in the drawing.

BRIEF DESCRIPTION OF THE DRAWINGS

The invention will be described in the following by way of example with reference to the drawing.

There are shown, schematically in each case.

DETAILED DESCRIPTION OF THE PREFERRED EMBODIMENTS

It must first be noted that the following description relates to a dimpled key of the type TSA006. For security reasons, the TSA006 key in FIG. 5 is not shown completely correctly, but is shown modified with respect to its coding and proportions. Accordingly, the associated lock cylinder is also shown modified in FIGS. 1 and 4.

Figure 1:
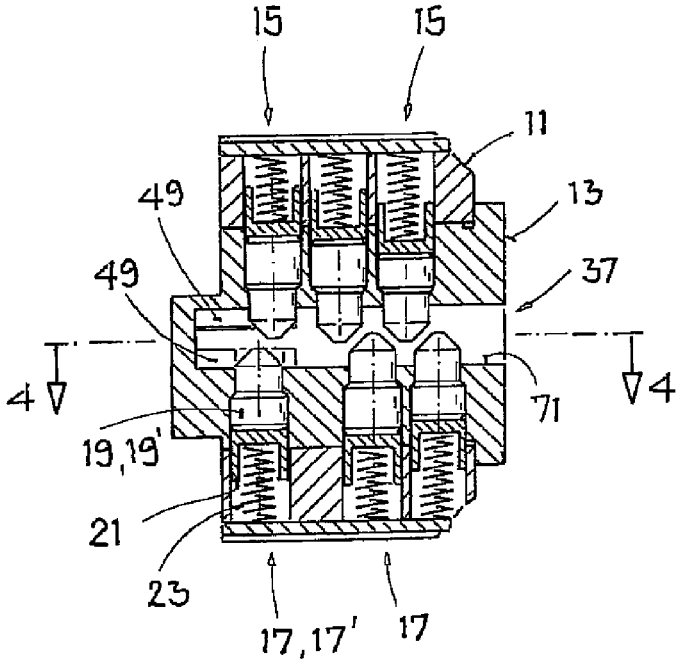
FIG. 1 a longitudinal section through a lock cylinder having a cylinder core in accordance with an embodiment of the invention.
Figure 2:
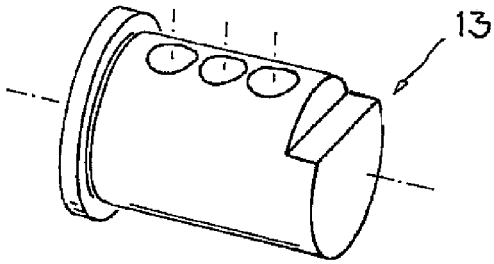
FIG. 2 a perspective view of the cylinder core of the lock cylinder of FIG. 1.

The lock cylinder shown in FIG. 1 includes a cylinder housing 11 and a cylinder core 13 which has a keyway 37 having a key introduction opening 71 and is rotatably supported in the cylinder housing 11. Furthermore, a plurality of tumblers 15, 17 are provided which are arranged in two rows which are disposed oppositely along the keyway 37. In the view in accordance with FIG. 1, three upper tumblers 15 can be recognized which are arranged in an upper row of tumblers (cf. also FIG. 2) and three lower tumblers 17 can be recognized which are arranged in a lower row of tumblers (cf. also FIG. 4), with only one tumbler 15, 17 from each row of tumblers being provided with a reference numeral for reasons of clarity. Each of the tumblers 15, 17 comprises a core pin 19, a housing pin 21 and a pin spring 23. The tumblers 15, 17 only permit a rotation of the cylinder core 13 in the cylinder housing 11 when a dimpled key (FIG. 5) associated with the lock cylinder has been introduced into the keyway 37 and the core pins 19 and housing pins 21 are displaced such that the pins 19, 21 release the separation plane between the cylinder housing 11 and the cylinder core 13.

Only for reasons of illustration, the tumblers 15, 17 have been urged back slightly out of the keyway 37 with respect to their position of rest when the dimpled key associated with the lock cylinder has not been introduced into the keyway 37. The tumblers 15, 17 have equidistant spacings from one another with the exception of the tumbler 17' of the lower row of tumblers furthest from the key introduction opening 71.

The dimpled key 25 for the actuation of the lock cylinder has two flat sides in accordance with FIG. 5 of which only the upper flat side 27 can be recognized in FIG. 5 due to the selected view (plan view). A plurality of dimples 29, 31 arranged in two rows 33, 35 are provided on the upper flat side 27. The row 33 is termed the "upper" row 33 in the following and the row 35 is termed the "lower" row 35. For reasons of clarity, where necessary, only one dimple 29, 31 of each row of dimples 33, 35 is provided with a reference numeral.

The upper row 33 includes four dimples 29 of which the three dimples 29 disposed closest to the key tip 39 cooperate with the three upper tumblers 15 of the lock cylinder when the dimpled key 25 has been introduced into the keyway 37 of the lock cylinder. The dimple 29 furthest from the key tip 39 is not used here.

The dimpled key 25 is made as a reversible key, i.e. the reversible key is symmetrical with respect to a rotation around its longitudinal axis by 180°. The same dimple pattern is therefore provided on the non-shown lower flat side of the dimpled key 25 as on the shown upper flat side 27, with a corresponding "upper" row 33 and a corresponding "lower" row 35. The dimpled key 25 is in this respect introduced into the keyway 39 of the lock cylinder off-center, offset laterally from the center of the cylinder core 13.

The "lower" row of the lower flat side formed in this respect directly beneath the "upper" row 33 of the upper flat side 27 shown in FIG. 5 therefore includes three dimples which correspond to the dimples 31 of the "lower" row 33 of the shown upper flat side 27. Of these three dimples, the two dimples 31 furthest from the key tip 39 cooperate with the two tumblers 17 disposed closest to the key introduction opening 71 (cf. FIG. 4 and the lower half of FIG. 1) when the dimpled key 25 has been introduced into the keyway 37 of the lock cylinder.

The upper row 33 of dimples 29 of the upper flat side 27 defines a coding section 41 of the upper flat side 27 of the dimpled key 25. It is adjoined by a dimple-free end section 43 of the upper flat side 27 of the dimpled key 25 extending up to the key tip 39. In an analog manner, the lower row 35 of dimples 31 of the upper flat side 27 defines a coding section 45 of the upper flat side 27 of the dimpled key 25 which is adjoined by a dimple-free end section 47 of the upper flat side 27 of the dimpled key 25. Corresponding coding sections and end sections are present on the lower flat side of the dimpled key 25.

The tumbler 17' of the lower row of tumblers furthest from the key introduction opening 71, which is here also the tumbler furthest from the key introduction opening 71 overall (cf. FIG. 4 and the lower half of FIG. 1), is provided in a section of the keyway 37 which receives the dimple-free end section of that row which, on the lower flat side of the dimpled key 25, corresponds to the "lower" row 35 of the upper flat side 27 shown in FIG. 5. The named furthest tumbler 17' is therefore arranged deeper in the keyway 37 than is provided by the dimple 31' of the "lower" row 35 (or by the corresponding dimple on the lower flat side of the dimpled key 25). This makes a lock picking of the lock cylinder more difficult. The named furthest tumbler 17' does not therefore cooperate with the predetermined dimples 29, 31 of the dimpled key 25.

Figure 3:
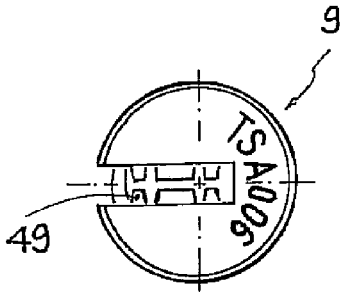
FIG. 3 a front view of the lock cylinder of FIG. 1.
Figure 4:
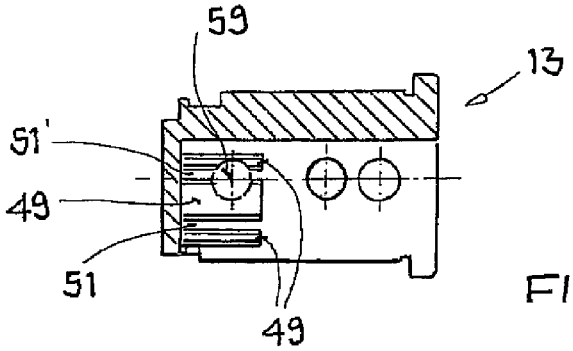
FIG. 4 a longitudinal section through the cylinder core of the lock cylinder of FIG. 1 along the line 4-4, with the longitudinal section in accordance with FIG. 4 standing perpendicular to the longitudinal section in accordance with FIG. 1.
Figure 5:
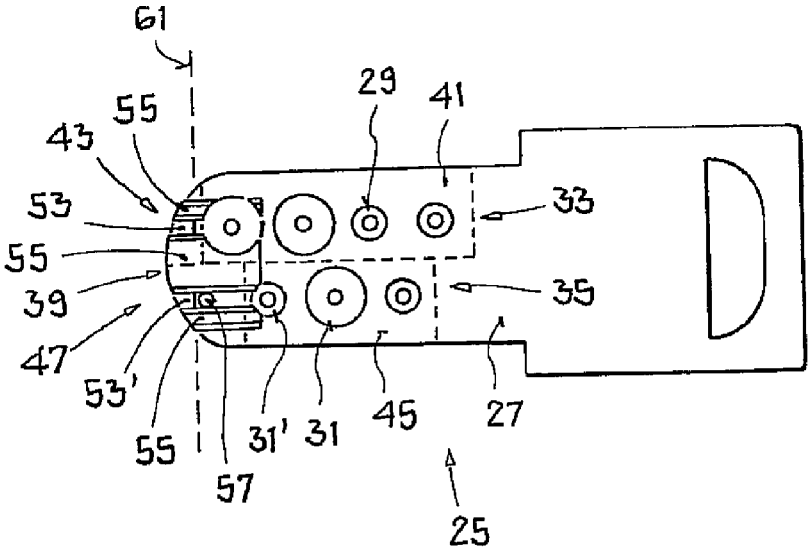
FIG. 5 a key associated with the lock cylinder in accordance with FIG. 1.

As can be recognized from FIGS. 1, 3 and 4, the cylinder core 13 has, in a region receiving the key tip 39, a plurality of webs 49 which each extend in the key introduction direction. The webs 49 project into the keyway 37. Grooves 51 of the cylinder core 13 are formed between the webs 49 of the cylinder core 13. The key tip 39 of the dimpled key 25 is made complementary thereto so that the webs 49 of the cylinder core 13 engage in grooves 55 of the dimpled key 25 (FIG. 5) and the webs 53 of the dimpled key 25 engage into the grooves 51 of the cylinder core when the dimpled key 25 has been introduced into the keyway 37. Only dimpled keys which have a pattern complementary to the pattern of the cylinder core 13 described above can therefore be completely introduced into the keyway 37.

The named furthest tumbler 17' is in this respect arranged such that the core pin 19' cooperates with the web 53' of the dimpled key 25 when the dimpled key 25 has been introduced into the keyway 37. The point of incidence of the core pin 19' on the web 53' is marked by the reference numeral 57 in FIG. 5. It can be recognized from FIG. 4 that the core pin axis 59 of the core pin 19' extends for this purpose through the groove 51' of the cylinder core 13 formed between the webs 49 of the cylinder core 13. The security against lock picking of the lock cylinder can hereby be further increased since it is made more difficult by the webs 49 bounding the groove 51' to urge the tumbler 17 back out of the keyway 37 by means of the named specially made breaking-open tools.

The tumblers 15 and 17 of the lock cylinder are coded to two different engagement depths at which the tumblers 15, 17 engage into the dimples 29, 31 of the dimpled key 25. The named furthest tumbler 17', in contrast, does not engage into any of the dimples 29, 31 of the dimpled key 25, but rather cooperates with the web 53' of the dimpled key 25. In the region of the point of incidence 57, the web 53' has a height which corresponds to the height of the dimpled key 25 at a point of the coding section 41, 45 at which no dimples 29, 31 are provided. The named furthest tumbler 17' is therefore coded to the key blank from which the dimpled key 25 is created, i.e. the tumbler 17' is coded to an engagement depth of zero. The other tumblers 15, 17 of the lock cylinder, which each cooperate with a dimple 29, 31 of the dimpled key 25, are coded either to a first engagement depth which is larger than zero or to a second engagement depth which is larger than the first engagement depth. In this respect, those tumblers 15, 17 which cooperate with dimples 29, 31 which have a smaller outer radius in the plan view in FIG. 5 are coded to the first engagement depth. Those tumblers 15, 17 which cooperate with dimples 29, 31 which have a larger outer radius in the plan view in FIG. 5 are coded to the second engagement depth.

It is, however, generally also possible that the point of incidence 57 of the core pin 19' is disposed on the web 53' in a region in which the web 53' is chamfered toward the key tip 39. This chamfered region starts remote from the line 61 drawn as an aid in FIG. 5. The named furthest tumbler 17' is in this case no longer coded to an engagement depth of zero. Intermediate engagement depths can hereby be coded to increase the security against manipulation even further.

Figure 6:
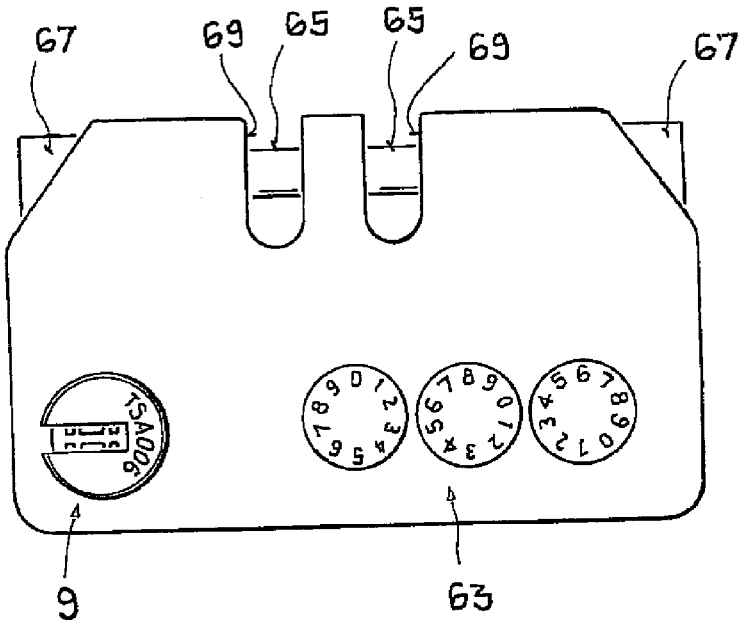
FIG. 6 a TSA baggage lock having the lock cylinder in accordance with FIG. 1.

FIG. 6 shows a baggage lock with a mechanical combination mechanism 63 which can be used to secure or release latches 65 provided for the latching of a zip or of a buckle of a piece of baggage in reception gaps 69 of the baggage lock. With a correctly set number combination (released state), the latches 65 can be retracted from the reception gaps 69 to release the respective zip or the respective buckle. This is done via actuation of press buttons 67. If, in contrast, an incorrect number combination is set (secured state), the latches 65 are blocked against retraction from the reception gaps 69. In addition to the mechanical combination mechanism 63, the baggage lock shown in FIG. 6 has a lock cylinder 9 as is described in connection with FIGS. 1 to 5. Independently of the set number combination, the latches 65 can also be released by means of the dimpled key associated with the lock cylinder 9. The baggage lock shown is therefore a so-called dual mechanism lock such as has been described in U.S. Pat. No. 6,513,356 B1 and U.S. Pat. No. 6,598,434 B2.

The invention claimed is:

1. A lock cylinder for a baggage lock, having a cylinder housing (11), furthermore having a cylinder core (13) which is rotatable in the cylinder housing (11) and which has a keyway (37) with a key introduction opening (71) and having a plurality of tumblers (15, 17) which are arranged in two rows which are oppositely disposed along the keyway (37), wherein the lock cylinder is actuable by means of an associated dimpled key (25) which includes, on two mutually oppositely disposed flat sides (27), a respective coding section (41, 45) provided with dimples (29, 31) and a respective dimple free end section (43, 47) adjoining said coding section and extending up to the key tip (39), wherein the associated key (25) is in particular of the type TSA006, wherein the tumbler (17') of at least one of the rows furthest from the key introduction opening (71) is arranged in a distal end of the keyway (37) which receives the dimple-free end section (43, 47) of the associated key (25) so that upon full insertion of said associated key said dimple-free end section (43, 47) of the associated key (25) engages and displaces said last mentioned tumbler (17') to enable said lock cylinder to be opened, wherein the last mentioned tumbler (17') includes a single core pin (19') with a core pin axis which extends through a groove (51') of the cylinder core (13) formed between adjacent webs (49) extending into the cylinder core (13) so that the webs cooperate with at least one groove (55) of the associated key (25) when the associated key (25) is fully inserted into the keyway (37).

2. A lock cylinder in accordance with claim 1, wherein the cylinder core (13) has, in a region which receives the key tip (39), a plurality of webs (49) which extend in the key introduction direction, with the webs (49) projecting into the keyway (37) to engage into complementary made grooves (55) of the associated key (25) when the associated key (25) has been introduced into the keyway (37).

3. A lock cylinder in accordance with claim 1, wherein the core pin (19') cooperates with a chamfered part of the web (53') of the associated key (25) when the associated key (25) has been introduced into the keyway (37).

4. A lock cylinder in accordance with claim 1, wherein the tumblers (15, 17) are coded to different engagement depths at which the tumblers (15, 17) engage into the dimples (29, 31) of the associated key (25), with the named furthest tumbler (17') being coded to an engagement depth of zero, whereas the other tumblers (15, 17) are either coded to a first engagement depth which is larger than zero or are coded to a second engagement depth which is larger than the first engagement depth.

5. A lock cylinder in accordance with claim 1, wherein the tumblers (15, 17) arranged in a row have equidistant spacings from one another with the exception of the named furthest tumbler (17').

6. A lock cylinder in accordance with claim 1, wherein the keyway (37) is arranged off-center in the cylinder core (13).

7. A baggage lock having a lock cylinder (9) in accordance with claim 1, furthermore having a further locking device (63) and having a latching mechanism (65) for the latching of a zip or of a buckle of a piece of baggage, wherein the latching mechanism (65) is selectively securable or releasable by means of the locking device (63) and wherein the latching mechanism (53) is releasable by means of the lock cylinder (9) while bypassing the locking device (63).

8. The lock cylinder as defined in claim 1 wherein said last mentioned tumbler (17') blocks said cylinder core (13) against rotation unless said last mentioned tumbler (17') is displaced by said dimple-free end section (43, 47) of said associated key (25) upon full insertion of said associated key (25).

* * * * *